US008777370B2

(12) United States Patent
Park

(10) Patent No.: US 8,777,370 B2
(45) Date of Patent: Jul. 15, 2014

(54) IMAGE FORMING APPARATUS

(75) Inventor: Soyoung Park, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/289,070

(22) Filed: Nov. 4, 2011

(65) Prior Publication Data

US 2012/0133706 A1 May 31, 2012

(30) Foreign Application Priority Data

Nov. 30, 2010 (JP) ..... 2010-266757

(51) Int. Cl.
*B41J 2/165* (2006.01)

(52) U.S. Cl.
USPC ..... 347/30

(58) Field of Classification Search
None
See application file for complete search history.

(56) References Cited

U.S. PATENT DOCUMENTS

| | | | | |
|---|---|---|---|---|
| 4,959,662 | A * | 9/1990 | Kobayashi | 347/25 |
| 5,055,856 | A * | 10/1991 | Tomii et al. | 347/30 |
| 5,504,508 | A | 4/1996 | Hashimoto | |
| 6,010,203 | A * | 1/2000 | Muraki | 347/30 |
| 7,104,628 | B2 * | 9/2006 | Yamazaki et al. | 347/29 |
| 2004/0252157 | A1 | 12/2004 | Yamazaki et al. | |
| 2005/0168517 | A1 | 8/2005 | Usuda | |
| 2006/0176333 | A1 * | 8/2006 | Momose et al. | 347/30 |
| 2011/0285783 | A1 | 11/2011 | Sakata et al. | |

FOREIGN PATENT DOCUMENTS

| | | |
|---|---|---|
| JP | 3-114337 | 11/1991 |
| JP | 2000-71466 | 3/2000 |
| JP | 2000-211164 | 8/2000 |
| JP | 2002-86746 | 3/2002 |
| JP | 2004-98408 | 4/2004 |
| JP | 2004-230844 | 8/2004 |
| JP | 2005-212378 | 8/2005 |
| JP | 2006-136793 | 6/2006 |
| JP | 2008-213219 | 9/2008 |
| WO | WO 2010/070975 | 6/2010 |

OTHER PUBLICATIONS

Chinese official action dated Dec. 9, 2013 in corresponding Chinese patent application No. 2011 10 38 6755.6.
Japanese official action dated Feb. 25, 2014 in corresponding Japanese patent application No. 2010-266757.

* cited by examiner

*Primary Examiner* — Matthew Luu
*Assistant Examiner* — Alejandro Valencia
(74) *Attorney, Agent, or Firm* — Cooper & Dunham LLP

(57) ABSTRACT

An image forming apparatus including a recording head having a nozzle surface on which multiple nozzles to eject droplets are arranged in a line; a suction device; and a cap to cover the nozzle surface of the recording head. The cap includes a suction hole to connect a space formed by the cap and the nozzle surface with the suction device; an air hole to connect the space with air; and an absorbent located inside the cap. The top surface of the absorbent is retracted from the contact portion of the cap to be contacted with the nozzle surface so that when the nozzle surface is capped with the cap, a flow passage is secured between the air hole to the suction hole without obstructed by the absorbent.

6 Claims, 9 Drawing Sheets

(a)

(b)

IMAGE FORMING APPARATUS

CROSS-REFERENCE TO RELATED APPLICATIONS

This patent application is based on and claims priority pursuant to 35 U.S.C. §119 to Japanese Patent Application No. 2010-266757, filed on Nov. 30, 2010, in the Japan Patent Office, the entire disclosure of which is hereby incorporated herein by reference.

FIELD OF THE INVENTION

This disclosure relates to an image forming apparatus, and particularly to an image forming apparatus having a recording head ejecting droplets.

BACKGROUND OF THE INVENTION

Image forming apparatuses having a recording head to eject droplets such as ink droplets have been used for printers, facsimiles, copiers, and multifunctional machines, and specific examples thereof include inkjet recording devices. Such image forming apparatuses record images by ejecting droplets such as ink droplets from a recording head toward a recording material such as a paper sheet. Such image forming apparatuses are broadly classified into serial image forming apparatuses in which a recording head ejects droplets while moving in a main scanning direction to form an image on a recording material fed in a sub-scanning direction, and line image forming apparatuses having a fixed line recording head ejecting droplets on a recording material fed in a direction.

In this application, image forming apparatuses mean apparatuses which eject ink droplets so as to be adhered to a recording material such as paper, yarn, fiber, fabric, leather, metal, plastic, glass, wood, and ceramic to form an image thereon. In addition, image formation means not only formation of a meaningful image such as letters and figures but also formation of a meaningless image such as patterns (i.e., mere adhesion of droplets on a recording material). Further, ink means not only so-called inks but also other liquids for use in image formation such as recording liquids, fixing liquids, liquids, and resins. Furthermore, recording material means not only recording sheets such as paper sheets and OHP sheets but also the above-mentioned materials. In addition, image means not only two-dimensional images but also images formed on a three-dimensional object and three dimensional images themselves formed by ink.

There are image forming apparatuses including a maintenance/recovery mechanism (hereinafter referred to as maintenance mechanism) having a cap to cover the nozzle surface of a recording head to prevent drying of the ink in the nozzles and to prevent the nozzles from dusts, and a wiper to wipe the nozzle surface to clean the nozzle surface, so that the nozzles of the recording head can maintain good ink ejecting stability. The wiper performs a recovery operation such that after nozzles discharge an ink (such as ink having an increased viscosity) in a cap, the wiper wipes the nozzle surface so that the ink can form meniscus in the nozzles.

There is a cap for use in such maintenance mechanisms, which includes a peripheral portion contacting the nozzle surface of a recording head on which nozzles to eject ink are formed; a bottom portion forming a closed space above the nozzle surface of the recording head together with the peripheral portion; a suction hole formed on the bottom portion to be connected with a negative pressure generating mechanism to suck the discharged ink; an ink absorbent arranged in the closed space so as to be contacted with the nozzle surface; and a sheet member located between the ink absorbent and the bottom portion and having an opening, at least part of which is connected with the suction hole. The ink discharged from the nozzles toward the cap in a maintenance operation is fed from the suction hole through the ink absorbent and the opening of the sheet member.

In addition, there is a cap for use in such maintenance mechanisms, which caps the surface of vertically arranged nozzles of a recording head and which has an air hole on an upper end portion thereof and a suction hole on a lower side portion thereof.

In the second mentioned cap, the cap is moved horizontally to perform a suction operation. In this regard, in order to prevent dripping of the discharged ink, a capping operation, a head sucking operation, an airing operation of airing the inside of the cap, and a decapping operation are performed in this order as the suction operation.

When such an ink absorbent as mentioned above is arranged in the cap so as to obstruct the air hole, an air bubble problem (non-ink-ejecting problem) is caused in that air fed into the cap in the airing operation and passing the ink-absorbed absorbent forms air bubbles, and the air bubbles enter into nozzles, thereby blocking flow of the ink in the nozzles, resulting in ejection of no ink droplets from the nozzles.

In addition, when the suction hole is occasionally obstructed with the ink absorbent, the suction hole is not connected with the nozzle surface, and the waste ink on the nozzle surface cannot be satisfactorily sucked because the ink absorbent serves as a resistive element, resulting in formation of residual waste ink in the cap. Such residual waste ink is adhered to the nozzle surface in the decapping operation, thereby contaminating the image forming apparatus. In addition, the wiper is easily deteriorated by the residual waste ink, resulting in shortening of life of the wiper.

For these reasons, the inventors recognized that there is a need for an image forming apparatus which hardly causes the above-mentioned air bubble problem while reducing the amount of residual waste ink in a cap even when the recording head of the image forming apparatus is a vertical recording head.

BRIEF SUMMARY OF THE INVENTION

As an aspect of this disclosure, an image forming apparatus is provided which includes a recording head having a nozzle surface on which multiple nozzles to eject droplets are arranged in a line; a suction device; and a cap to cover the nozzle surface of the recording head. The cap includes a suction hole to connect a space formed by the cap and the nozzle surface with the suction device; an air hole to connect the space with air; and an absorbent located inside the cap. The top surface of the absorbent is retracted from the contact portion of the cap to be contacted with the nozzle surface so that when the nozzle surface is capped with the cap, a flow passage is secured between the air hole to the suction hole without obstructed by the absorbent.

The aforementioned and other aspects, features and advantages will become apparent upon consideration of the following description of the preferred embodiments taken in conjunction with the accompanying drawings.

DETAILED DESCRIPTION OF THE INVENTION

The image forming apparatus of this disclosure will be described by reference to drawings.

Initially, an example of the image forming apparatus of this disclosure will be described by reference to FIGS. 1 and 2.

Figure 1:
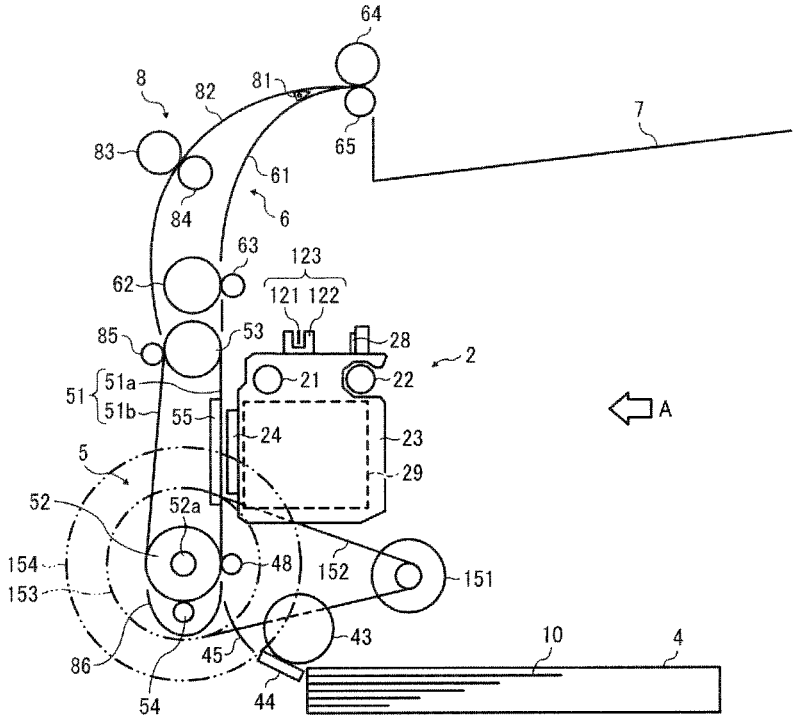
FIG. 1 is a schematic side view illustrating an example of the image forming apparatus of this disclosure.
Figure 2:
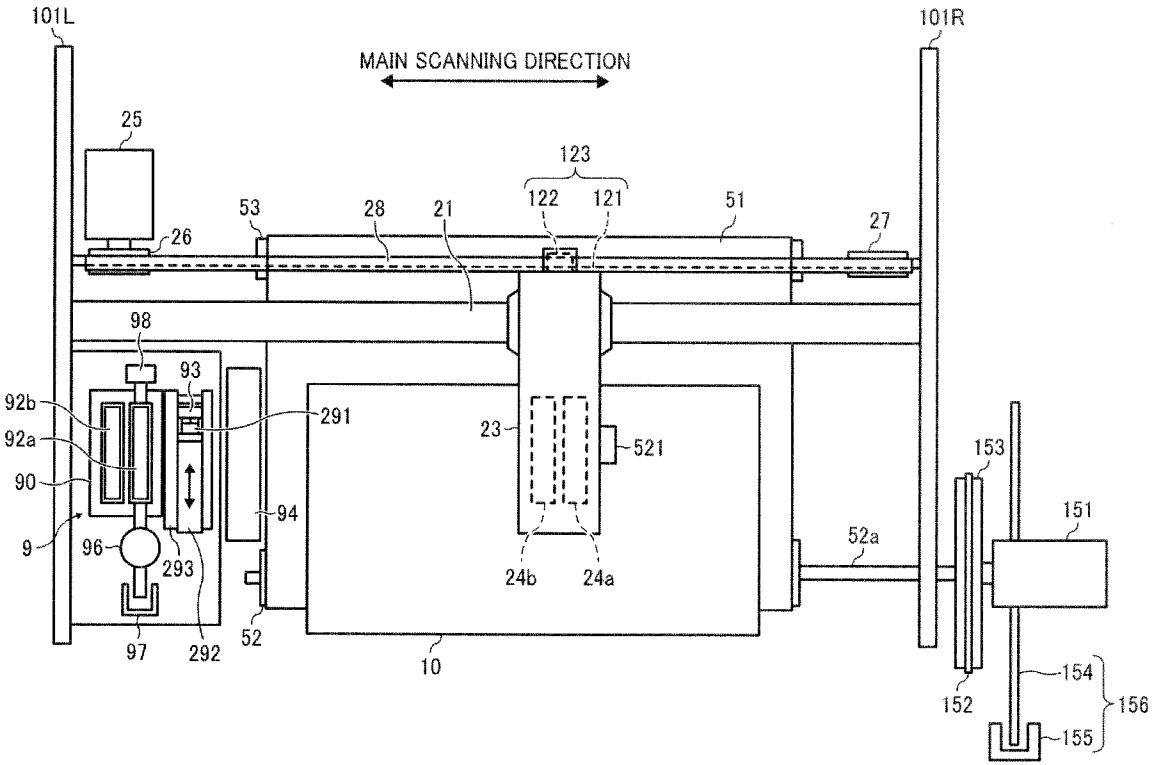
FIG. 2 is a schematic view illustrating the image forming apparatus from a direction indicated by an arrow A in FIG. 1.

FIG. 1 is a schematic side view illustrating an example of the image forming apparatus of this disclosure, and FIG. 2 is a schematic view illustrating the image forming apparatus from a direction indicated by an arrow A in FIG. 1.

This image forming apparatus is a serial image forming apparatus, and includes an image forming section 2 and a recording material feeder 5, which are located in a main body of the image forming apparatus, a recording material cassette 4 located at a lower portion of the main body to contain a stack of paper sheets 10 serving as a recording material, and a recording material discharger 6. The recording material feeder 5 feeds vertically the paper sheets 10 one by one, which are fed intermittently from the recording material cassette 4. The image forming section 2 ejects droplets horizontally to form an image on the paper sheet 10. The recording material discharger 6 vertically discharges the paper sheet 10 bearing an image thereon so that the paper sheet 10 is stacked on a tray 7.

When duplex printing is performed, the paper sheet 10 bearing an image on one side thereof is fed by the recording material discharger 6 to a reversing mechanism 8. The reversing mechanism 8 feeds the paper sheet 10 to the recording material feeder 5, and the recording material feeder 5 feeds downward the paper sheet 10 to reverse the paper sheet 10. The revered paper sheet 10 is fed again to the image forming section 2 so that another image is formed on the other side thereof. The paper sheet 10 bearing images on both sides thereof is discharged by the recording material discharger 6 so as to be stacked on the tray 7.

The image forming section 2 includes left and right side plates 101L and 101R, a main guide member 21 and a sub guide member 22 supported by the left and right side plates 101L and 101R, a carriage 23 bearing a recording head 24 slidably supported by the main and sub guide members 21 and 22, a main scanning motor 25, a driving pulley 26 and a driven pulley 27, and a timing belt 28 tightly stretched across the pulleys 26 and 27. The carriage 23 bearing the recording head 24 is moved in a main scanning direction by the timing belt 28 which is moved by the motor 25 via the pulleys 26 and 27.

The recording head 24 on the carriage 23 has liquid ejecting heads 24*a* and 24*b* each having multiple nozzles arranged in a sub-scanning direction perpendicular to the main scanning direction to horizontally eject yellow (Y), magenta (M), cyan (C), and black (K) ink droplets. Namely, the recording head 24 uses a horizontal-ejecting method in which multiple nozzles are vertically arranged to eject color ink droplets horizontally.

Figure 3:
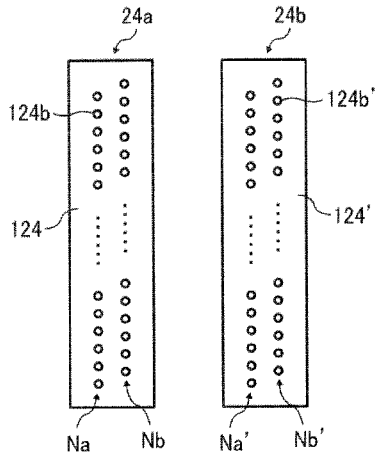
FIG. 3 is a schematic view illustrating a recording head of the image forming apparatus.

As illustrated in FIG. 3, the liquid ejecting head 24*a* has a line nozzle 124*b* including lines of nozzles Na and Nb to eject yellow (Y) ink droplets and magenta (M) ink droplets, respectively, and the other liquid ejecting head 24*b* has anther line nozzle 124*b*' including lines of nozzles Na' and Nb' to eject cyan (C) ink droplets and black (K) ink droplets, respectively.

Specific examples of the liquid ejecting heads 24*a* and 24*b* include piezoelectric actuators using a piezoelectric element, thermal actuators utilizing phase change (evaporation) of a liquid film performed by using an electricity-heat conversion element such as resistors, shape-memory-alloy actuators utilizing phase change of a metal caused by temperature change, and electrostatic actuators utilizing electrostatic force. The carriage 23 can have a liquid ejecting head to eject a fixing liquid, which is reacted with the inks to fix the inks on the recording material 10.

The carriage 23 has a head tank 29 (illustrated in FIG. 1), which receives Y, M, C and K inks from Y, M, C and K ink cartridges, which serve as main tanks and which are detachably attached to the main body of the image forming apparatus, to supply the Y, M, C and K inks to the nozzles Na, Nb, Na' and Nb'.

Referring back to FIG. 2, an encoder scale 121 having a predetermined pattern thereon in the main scanning direction is provided between the side plates 101L and 101R, and the carriage 23 has an encoder sensor 122 including a transmission photo-sensor to read the pattern on the encoder scale 121. The encoder scale 121 and the encoder sensor 122 constitute a linear encoder (i.e., main scanning encoder) 123 to detect movement of the carriage 23.

A maintenance mechanism 9 to maintain and recover the conditions of the nozzles Na, Nb, Na' and Nb' of the recording head 24 is provided on one side of the image forming apparatus in the main scanning direction. The maintenance mechanism 9 has a frame 90, and a suction cap 92*a* and a cap 92*b* to respectively cap nozzle surfaces 124 and 124' (illustrated in FIG. 3) of the recording head 24, and a wiper (wiping blade) 93 to wipe the nozzle surfaces 124 and 124' while moving in a direction indicated by an arrow (i.e., vertical direction), which are supported by the frame 90. In addition, the maintenance mechanism 9 includes an ink receiver 94 to receive waste color inks in a preliminary ejecting operation (i.e., idling operation) in which viscosity-increased color inks in the surface portions of the nozzles Na, Nb, Na' and Nb' are ejected to be disposed of. The suction cap 92*a* is connected with a suction pump 96, which is connected with a waste ink tank 97. In addition, the suction cap 92*a* has an openable and closable air valve 98 to air the closed space formed by the suction cap 92*a* and the nozzle surface 124 of the recording head 24.

An uppermost paper sheet of the paper sheets 10 in the recording material cassette 4 is fed to the main body of the image forming apparatus while separated from the following paper sheet by a combination of a feed roller 43 and a separation pad 44, so that the fed paper sheet reaches a nip between a feed belt 51 and a pressing roller 48 of the recording material feeder 5 along a guide member 45. The paper sheet 10 is then fed by the feed belt 51 while adhered to the feed belt 51.

The recording material feeder 5 includes the feed belt 51 tightly stretched across a feed roller 52 (serving as a driving roller) and a driven roller 53, a charging roller 54 to charge the feed belt 51, and a platen 55 to maintain flatness of the feed belt 51 at a position opposed to the image forming section 2.

The feed belt 51 is rotated in the sub-scanning direction by the driving roller 52 which is rotated by a sub-scanning motor 151 via a timing belt 152 and a timing pulley 153. As illustrated in FIG. 1, the feed belt 51 is constituted of a normal feeding portion 51*a* extending in a direction of from the feed roller 52 to the driven roller 53 and facing the image forming section 2 to feed the paper sheet 10 in the sub-scanning direction while attracting the paper sheet, and a reverse feeding portion 51*b* extending in a direction of from the driven roller 53 to the feed roller 52.

As illustrated in FIG. 2, a code wheel 154 having a predetermined pattern is provided on a shaft 52*a* of the feed roller 52 while an encoder sensor 155 having a transmission photosensor is provided to detect the pattern of the code wheel 154. The code wheel 154 and the encoder sensor 155 constitute a rotary encoder (i.e., sub-scanning encoder) 156 to detect travel distance and position of the feed belt 51.

Referring back to FIG. 1, the recording material discharger 6 includes a discharge guide member 61, a combination of a discharge feed roller 62 and a first spur 63, and a combination of a discharge roller 64 and a second spur 65 to discharge the paper sheet 10 bearing an image thereon so as to be stacked on the discharge tray 7 in such a manner that the recorded image faces the surface of the tray 7.

The reversing mechanism 8 switches the paper sheet 10, part of which has been discharged toward the discharge tray 7, back toward the nip between the feed belt 51 and the pressing roller 48. The reversing mechanism 8 includes a switching pick 81 to switch the discharge passage to the reverse passage, a reverse guide member 82, a combination of a reverse roller 83 and a third spur 84 serving as a reverse roller, an auxiliary reverse roller 85 opposed to the driven roller 53, the reverse feeding portion 51*b* of the feed belt 51, a turning guide member 86 to guide the paper sheet 10, which has been separated from the reverse feeding portion 51*b*, to the nip between the feed belt 51 and the pressing roller 48 via the charging roller 54.

In this example of the image forming apparatus, the paper sheets 10 in the recording material tray 4 are fed one by one, and the thus fed paper sheet 10 is vertically fed by the charged feed belt 51 while electrostatically adhered thereto. The recording head 24 is driven according to image signals while moving the carriage 23 bearing the recording head 24 in the main scanning direction to eject droplets of the color inks toward the stopped paper sheet 10, thereby forming a line of image on the paper sheet 10. After the one-line image is recorded, the paper sheet 10 is fed in a predetermined amount in the sub-scanning direction, and a next one-line image is formed on the paper sheet 10. By repeating this recoding operation, a color image is formed on the paper sheet 10. The paper sheet 10 bearing the color image is discharged from the main body of the image forming apparatus so as to be stacked on the discharge tray 7.

When the nozzles Na, Nb, Na' and Nb' are subjected to a maintenance and recovery treatment, the carriage 23 is moved to a position such that the nozzle surfaces 124 and 124' face the maintenance mechanism 9. The suction cap 92*a* of the maintenance mechanism 9 caps the nozzle surface 124 (or 124') and sucks color inks so that the nozzles Na and Nb (or Na' and Nb') are subjected to a maintenance and recovery treatment and thereby color inks can be stably ejected from the nozzles thereafter, resulting in formation of high quality color images. In the maintenance and recovery treatment, the liquid ejecting head 24*a* is initially subjected to the maintenance and recovery treatment, and then the other liquid ejecting head 24*b* is subjected to the maintenance and recovery treatment after the carriage is moved in the main scanning direction.

When duplex printing is performed, initially an image is formed on one side of the paper sheet 10 as mentioned above. When the rear edge of the paper sheet 10 bearing the image thereon passes the switching pick 81, the discharge roller 64 is reversely rotated to switch the paper sheet 10 back. The paper sheet 10 is then fed to the nip between the reverse roller 83 and the third spur 84 while guided by the reverse guide member 82, and then fed to the nip between the reverse feed portion 51*b* of the feed belt 51 and the auxiliary reverse roller 85.

Thereafter, the paper sheet 10, which is adhered to the feed belt 51, is fed by the rotated feed belt. After the paper sheet 10 is separated from the feed belt 51 at the feed roller 52, the paper sheet 10 is fed again to the nip between normal feed portion 51*a* of the feed belt 51 and the pressing roller 48 so as to be adhered to the feed belt. After another image is recorded on the opposite side of the paper sheet 10 by the recording head 24, the duplex copy is discharged from the main body of the image forming apparatus so as to be stacked on the discharge tray 7.

In this regard, since the charging roller 54 is arranged inside the turning guide member 86, the feed belt 51 is always charged newly by the charging roller 54, and thereby the paper sheet 10 can be well adhered to the feed belt 51.

Next, the ink supply and discharge operation will be described by reference to FIG. 4.

The main tank (i.e., ink cartridge) 11 contains an ink to be ejected from the recording head 24, and is detachably attached to the main body of the image forming apparatus. The main tank 11 is connected with the head tank 29 by a tube 12, which serves as an ink supply passage and to which a reversible pump 13 is attached. When the reversible pump 13 is normally rotated, the ink is fed from the main tank 11 to the head tank 29, and when the reversible pump 13 is reversely rotated, the ink is returned from the head tank 29 to the main tank 11.

The recording head 24 is connected with the head tank 29 via a filter unit. The head tank 29 supplies the Y, M, C or K ink to a common ink chamber 124*a*, and the ink in the common ink chamber is then supplied to individual chambers. The ink in the individual chambers is pressed to be ejected as ink droplets from the line nozzle 124*b* (or 124*b*'). By returning the ink from the head tank 29 to the main tank 11 by reversely operating the pump 13, a negative pressure is formed in the head tank 29.

The suction cap 92*a* to cap the nozzle surface 124 (or 124') of the recording head 24 extends vertically so as to face the recording head 24, and is moved forward and backward so as to be attached to or detached from the recording head 24 by a cap moving mechanism 531 mentioned later.

Figure 4:
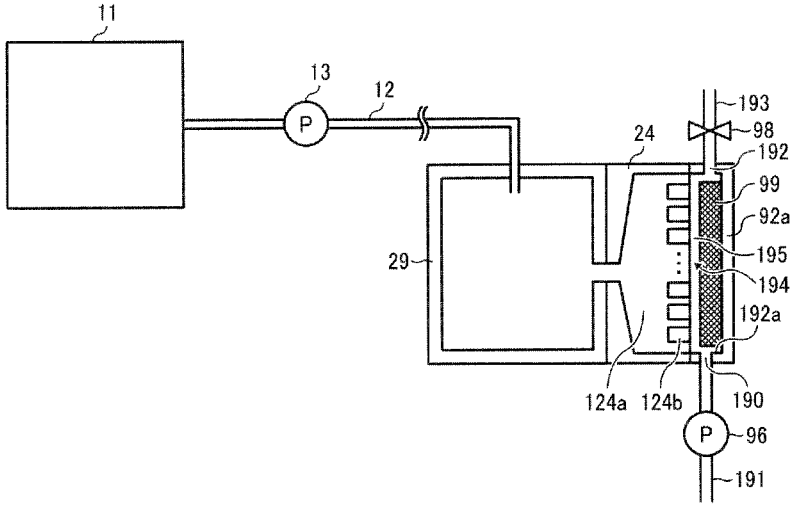
FIG. 4 is a schematic view illustrating an ink supplying and discharging section of the image forming apparatus.

Referring to FIG. 4, the suction cap 92*a* has an exit (suction hole) 190 at a bottom surface 192*a* thereof. The suction hole 190 is connected with an ink discharge passage 191, which is connected with the waste ink tank 97 and on which the suction pump 96 serving as a suction device is provided. In addition, the suction cap 92*a* has an air hole 192 at an upper portion thereof. The air hole 192 is connected with an air opening passage 193 so that a space 194 formed by the cap and the surface 124 of the recording head 24 can be connected with air through the air opening passage 193. The air valve 98 is provided on the air opening passage 193. An ink absorbent 99 is provided on an inner surface of the suction cap 92*a* so that a flow passage 195 can be secured in the space 194 between the air hole 192 and the suction hole 190 without obstructed by the absorbent 99.

Figure 5:
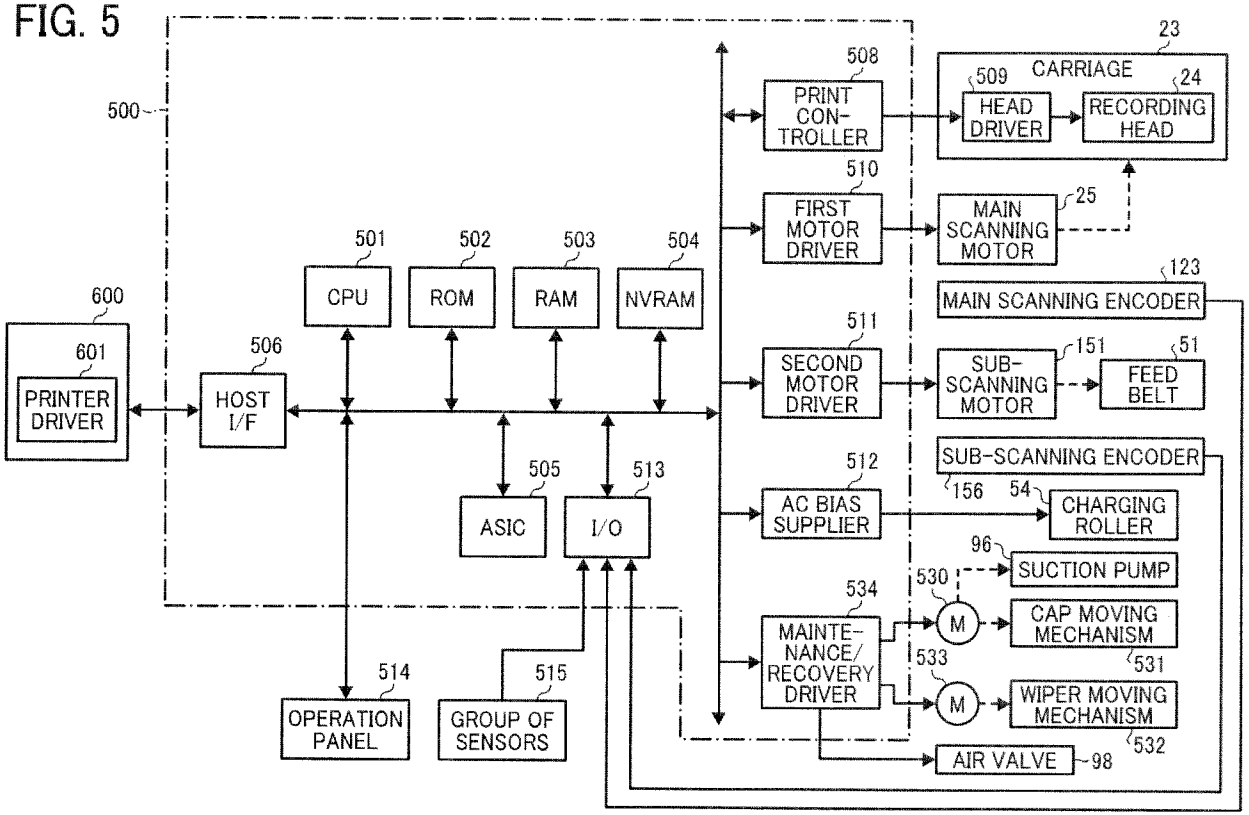
FIG. 5 is a block diagram illustrating a controller of the image forming apparatus.

Next, the controller of this example of the image forming apparatus will be described by reference to FIG. 5.

A controller 500 includes a CPU 501 to control the entire of the image forming apparatus, a ROM 502 to store various kinds of programs including a program for use in executing the control operation performed by the CPU 501, and other fixed data, a RAM 503 to temporarily store data such as image data, a rewritable nonvolatile memory 504 to store data even when a power is not supplied to the image forming apparatus, and an ASIC 505 to perform signal processing for image data, image processing such as sorting, and input/output signals processing for controlling the entire of the image forming apparatus.

Further, the controller 500 includes a print controller 508 including a data transferring device and a drive signal generator to perform drive control on the recording head 24, a head driver (driver IC) 509 to drive the recording head 24, a first motor driver 510 to drive a main-scanning motor 25 to move the carriage 23 in the main scanning direction, a second motor driver 511 to drive a sub-scanning motor 151 to rotate the feed belt 51, an AC bias supply 512 to supply an AC bias to the charging roller 54, etc.

The controller 500 is connected with an operation panel 514, from which information is input to the image forming apparatus and which displays information.

The controller 500 also has a host I/F 506 which sends and receives data and signals to or from a host 600 such as information processors (e.g., personal computers), image readers (e.g., image scanners), imaging devices (e.g., digital cameras) through a cable or a network.

The CPU 501 of the controller 500 reads out print data in a receive buffer included in the host I/F 506 while analyzing the data, and the ASIC 505 performs an image processing and a sorting processing on the data. The thus processed image data are transferred from the print controller 508 to the head driver 509. In this regard, dot pattern data for use in outputting an image are generated by a printer driver 601 of the host 600.

The print controller 508 not only transfers the above-mentioned image data as serial data, but also outputs a transfer clock pulse, a latch signal, and a control signal, which are necessary for image data transfer, to the head driver 509. In addition, the print controller 508 has a drive signal generator constituted of a D/A converter to subject pattern data of a drive pulse stored in the ROM 502 to D/A conversion, a voltage amplifier, a current amplifier, etc., to output a drive signal constituted of one drive pulse or plural drive pulses.

The head driver 509 drives the recording head 24 by selectively applying a driving pulse, which constitutes a driving signal input from the print controller 508 according to serially input image data to be recorded by one line scanning of the recording head 24, to a driving device (such as piezoelectric elements), so that the driving device generates energy for ejecting ink droplets from the nozzles. In this regard, by properly selecting a driving pulse, for example, ink droplets with different sizes (large, medium or small-sized ink droplets) can be ejected.

An I/O device 513 obtains information from the main scanning encoder 123, the sub-scanning encoder 156, and a group of sensors 515 provided on the image forming apparatus to extract information necessary for controlling the image forming apparatus. The extracted information is used for controlling the print controller 508, the motor drivers 510 and 511, and the AC bias supplier 512. The sensors 515 include an optical sensor (paper sensor) 521 provided on the carriage 23 to detect the position of the paper sheet 10, a thermistor to check the temperature and humidity in the image forming apparatus, a sensor to check the voltage of the charged belt, and an interlock switch to detect whether the cover of the image forming apparatus is opened or closed. The I/O device 513 processes the information from the sensors 515.

For example, the CPU 501 calculates a drive output value (control value) for driving the main scanning motor 25 based on the values of speed and position detected by sampling the detection pulses from the encoder sensor 122 and the target values of speed and position obtained from the speed/position profile previously stored in the CPU, and drives the main scanning motor 25 via the motor driver 210 based on the thus determined control value. Similarly, the CPU 501 calculates a drive output value (control value) for driving the sub-scanning motor 151 based on the values of speed and position detected by sampling the detection pulses from the encoder sensor 155 and the target values of speed and position obtained from the speed/position profile previously stored in the CPU, and drives the sub-scanning motor 151 via the motor driver 211 based on the thus determined control value.

The controller 500 performs control of drive on a maintenance/recovery motor 530 via a maintenance/recovery driver 534 to move the cap moving mechanism 531, which moves the cap 92 forward or backward relative to the nozzle surface 124 of the recording head 24, while driving the suction pump 96. In this regard, when the maintenance/recovery motor 530 is rotated in a direction, the cap 92 is moved relative to the nozzle surface 124 of the recording head 24 by the cap moving mechanism 531, and when the maintenance/recovery motor 530 is rotated in the opposite direction, the suction pump 96 is driven, thereby performing a suction operation.

In addition, the controller 500 performs control of drive on a motor 533 via the maintenance/recovery driver 534 to drive a wiper moving mechanism 532, which moves the wiper 93. Further, the controller 500 performs control of opening and closing the air valve 98 via the maintenance/recovery driver 534.

Next, the maintenance/recovery operation (hereinafter referred to as maintenance operation) of the image forming apparatus will be described by reference to the flowchart illustrated in FIG. 6.

In a case where the line nozzle 124*b* (or 124*b*') is clogged with the ink or a case where the meniscus of the ink in the nozzles is damaged due to insufficient negative pressure in the head tank 29, or at a predetermined time, a maintenance operation is performed on the recording head 24.

In the maintenance operation, the recording head 24 is moved so as to face the suction cap 92*a*. The cap moving mechanism 531 is driven to move the suction cap 92*a* so as to cap the nozzle surface 124 of the recording head 24 (capping operation in FIG. 6). In this case, the air valve 98 is closed.

Figure 6:
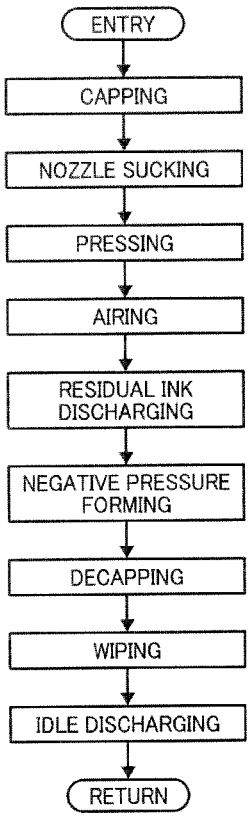
FIG. 6 is a flowchart for explaining a maintenance operation of the image forming apparatus.

Next, the suction pump 96 is driven to form a negative pressure in the space 194 formed by the suction cap 92*a* and the nozzle surface 124 so that an ink sucking operation, in which the ink in the line nozzle 124*b* (or 124*b*') is sucked so as to be discharged to the suction cap 92*a*, is performed (nozzle sucking operation in FIG. 6).

After performing the nozzle sucking operation, the reversible pump 13 is normally driven to supply the ink from the main tank 11 to the head tank 29 while performing a pressure changing operation such as reduction of the negative pressure level of the head tank 29 and the recording head 24 or formation of a positive pressure in the head tank and the recording head (pressing operation in FIG. 6).

After performing the pressing operation, an airing operation in which the air valve 98 is opened to air the space 194 in the suction cap 92*a* is performed (airing operation in FIG. 6). In this regard, since the suction pump 96 is continuously driven or is driven again, the residual ink in the suction cap 92*a* is fed to the waste ink tank 97 through the ink discharge passage 191. Thus, a residual ink discharging operation is performed (residual ink discharging operation in FIG. 6).

After performing the residual ink discharging operation, the reversible pump 13 is reversely driven to return the ink in the head tank 29 to the main tank 11, thereby forming a predetermined negative pressure in the head tank 29 and the recording head 24. Thus, a negative pressure forming operation is performed (negative pressure forming operation in FIG. 6).

Next, the cap moving mechanism 531 is moved to separate the cap 92*a* from the nozzle surface 124. Thus, a decapping operation is performed (decapping operation in FIG. 6). Thereafter, the nozzle surface 124 of the recording head 24 is wiped with the wiper 93 so as to be cleaned (wiping operation in FIG. 6).

Thereafter, an idle discharging operation in which the ink is ejected toward the ink receiver 94 is performed (idle discharging operation in FIG. 6).

Next, the suction cap and the maintenance operation will be described by reference to FIG. 7.

As mentioned above, the suction cap 92*a* has the suction hole 190 at the bottom surface 192*a* thereof, which is connected with the waste ink tank 97 through the ink discharge passage 191, wherein the suction pump 96 is provided in the ink discharge passage 191.

In addition, the suction cap 92*a* has the air hole 192 at an upper portion thereof. The air hole 192 is connected with the air opening passage 193 so that the space 194 formed by the suction cap 92*a* and the nozzle surface 124 of the recording head 24 can be connected with air through the air opening passage 193. The air valve 98 is provided in the air opening passage 193 to open and close the air opening passage 193. Although the air hole 192 extends vertically in FIG. 7, the direction is not particularly limited, and the air hole may extend horizontally.

Further, the ink absorbent 99 is provided on an inner surface of the suction cap 92*a*, so that the flow passage 195 can be secured in the space 194 between the air hole 192 and the suction hole 190 without obstructed by the ink absorbent 99.

Figure 7:
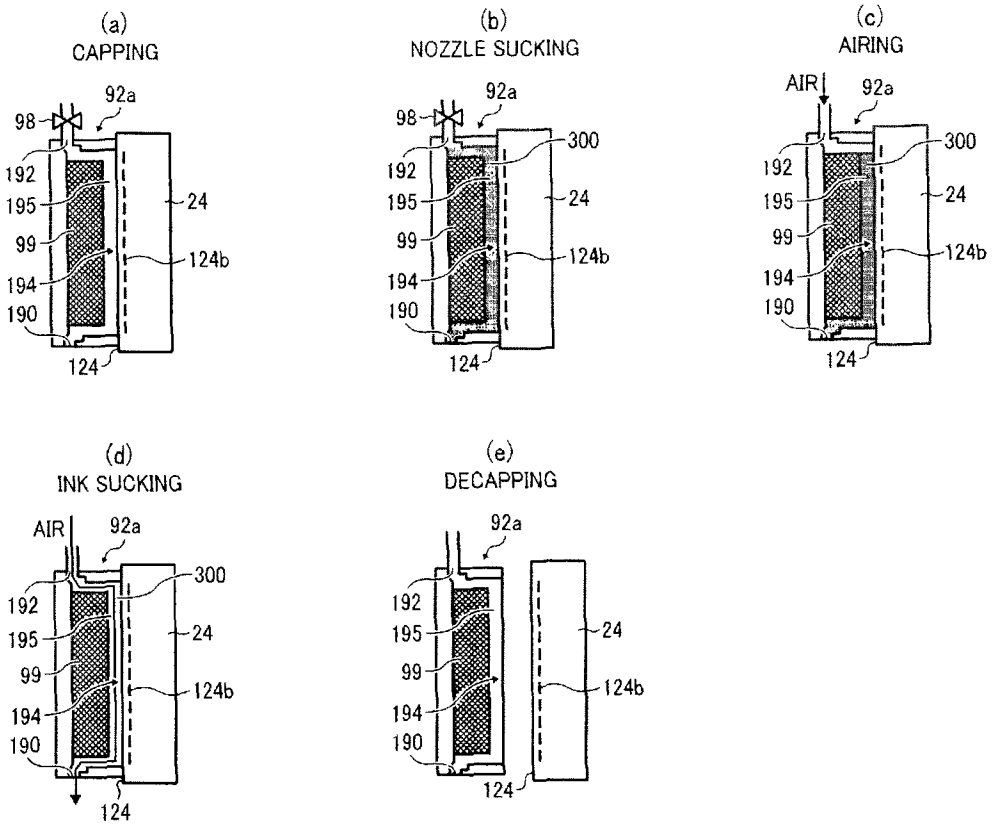
FIGS. 7(*a*)-7(*e*) are schematic views for explaining a suction operation of the image forming apparatus.

In the maintenance operation, initially the nozzle surface 124 of the recording head 24 is capped with the suction cap 92*a* as illustrated in FIG. 7(*a*). Next, a nozzle sucking operation is made by the suction pump 96 as illustrated in FIG. 7(*b*), thereby discharging an ink 300 in the space 194 of the suction cap 92*a*. Thereafter, the air valve 98 is opened to connect the space 194 with air through the air hole 192 as illustrated in FIG. 7(*c*). Further, the residual ink in the in the suction cap 92*a* is sucked by the suction pump 96 as illustrated in FIG. 7(*d*). Thereafter, the suction cap 92*a* is separated from the nozzle surface 124 of the recording head 24 (i.e., a decapping operation is performed) as illustrated in FIG. 7(*e*).

In this maintenance operation, the air hole 192 and the suction hole 190 are not obstructed by the ink absorbent 99 of the suction cap 92*a*, and the flow passage 195 can be secured between the air hole 192 and the suction hole 190 without obstructed by the absorbent 99. Therefore, occurrence of the air bubble problem (non-ink-ejecting problem) in that air fed into the cap in the airing operation and passing the ink absorbed by the absorbent forms air bubbles, and the air bubbles enter into nozzles, thereby blocking flow of the ink in the nozzles, resulting in ejection of no ink droplets from the nozzles can be prevented.

In addition, since the suction hole 190 is connected with the nozzle surface 124 of the recording head 24 without obstructed by the ink absorbent 99, discharging of the residual ink in the suction cap 92*a* can be smoothly performed without obstructed by the ink absorbent 99, resulting in reduction of the amount of the residual ink in the suction cap 92*a* after the maintenance operation.

Thus, the maintenance mechanism 9 has a configuration such that when the nozzle surface 124 is capped with the suction cap 92*a*, the flow passage 195 can be secured between the air hole 192 and the suction hole 190 without obstructed by the ink absorbent 99. Namely, the top surface of the absorbent 99 is retracted from a contact portion of the cap contacting the nozzle surface 124 of the recording head 24. Therefore, even when a recording head in which the nozzle surface faces vertically is used, occurrence of the air bubble problem can be prevented and the amount of the residual ink in the suction cap 92*a* after the maintenance operation can be reduced.

Next, an example of the wiper will be described by reference to FIGS. 8 and 9.

Figure 8:
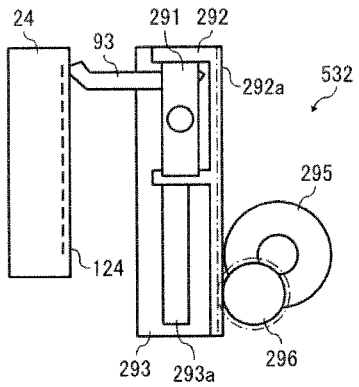
FIGS. 8(*a*)-8(*b*) are schematic views illustrating a wiper of the image forming apparatus.
Figure 8:
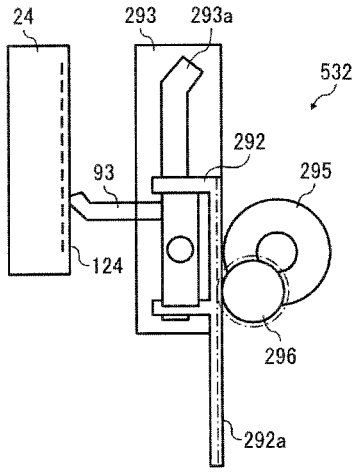
Figure 9:
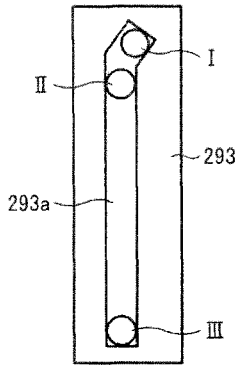
FIG. 9 is a schematic view illustrating a guide groove of the wiper of the image forming apparatus.

FIGS. 8(*a*)-8(*b*) are schematic views illustrating an example of the wiper of the image forming apparatus, and FIG. 9 is a schematic view illustrating a guide groove of the wiper.

The wiper moving mechanism 532 includes the wiper 93, and a holding member 291 holding the wiper 93, and a slider 292 having a rack portion 292*a* supporting the holding member 291. The slider 292 is supported by a guide rail 293 so as to be slid along the guide groove 293*a*. A driving motor 295, which is a stepping motor, transmits a driving force to the rack portion 292*a* of the slider 292 via a pinion gear 296 to move the slider 292 vertically, thereby moving the wiper 93 vertically.

The guide groove 293*a* of the guide rail 293 has such a configuration as illustrated in FIG. 9. When the slider 292 takes a position I, the wiper 93 is separated from the nozzle surface 124. When the slider 292 takes a position II, the wiper 93 is contacted with the nozzle surface 124 and starts to wipe the nozzle surface 124. When the slider 292 takes a position III, the wiper 93 ends the wiping operation.

The wiping operation will be described in detail. After the decapping operation is completed as illustrated in FIG. 7(*e*), the wiper 93 is moved from the upper portion of nozzle surface 124 to the lower portion of the nozzle surface 124 to wipe the nozzle surface 124 so that the ink adhered to the nozzle surface 124 is removed and the ink in the nozzles form meniscus.

When the ink used for the recording head 24 is a quick-drying ink, the ink adhered to the nozzle surface 124 rapidly increases the viscosity thereof. When the wiper 93 wipes such a viscous ink, it is necessary to provide an ink remover to remove the viscous ink from the wiper, resulting in increase of the costs. In addition, a problem is caused in that the viscous ink accumulating on the wiper without being discharged to the waste tank 97 is adhered to the nozzle surface 124, thereby contaminating the recording material such as paper sheet.

Therefore, in the wiping operation of this image forming apparatus, the ink is discharged from the line nozzle 124*b* before the wiper 93 wipes the nozzle surface 124. By performing such a wiping operation, the viscosity of the viscous ink adhered to the nozzle surface 124 is reduced, and therefore the wiping operation can be securely performed without causing the above-mentioned problem.

Next, an example of setting of the ink absorbent 99 in the suction cap 92*a* will be described by reference to FIG. 10.

Figure 10:
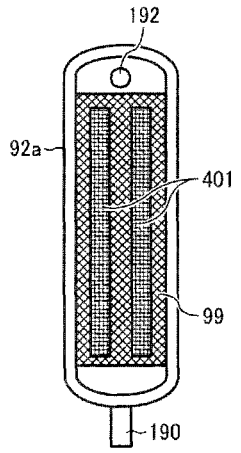
FIG. 10 is a front view illustrating an example of the cap to cover the recording head of the image forming apparatus.

FIG. 10 is a front view illustrating an example of the suction cap 92*a* when the cap is observed from the side thereof to be contacted with the nozzle surface 124. In FIG. 10, the ink absorbent 99 is illustrated so as to be transparent only for illustrative purposes.

In this example, the ink absorbent 99 is fixed to the inner wall of the suction cap 92*a* with one or more pieces of a double-faced adhesive tape 401.

Another example of setting of the ink absorbent 99 in the suction cap 92*a* will be described by reference to FIG. 11.

Figure 11:
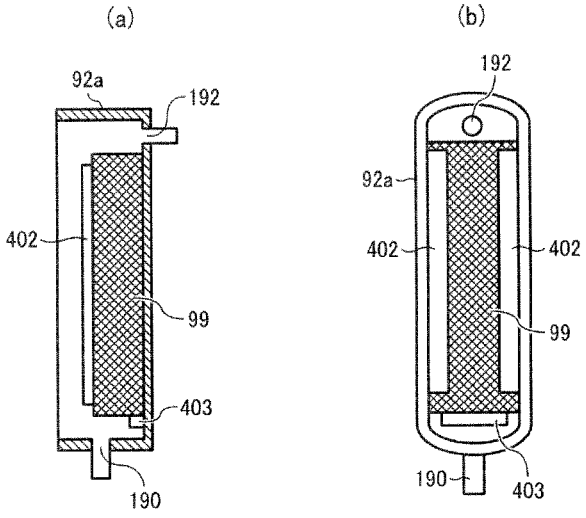
FIGS. 11(*a*)-11(*b*) illustrate another example of the cap to cover the recording head of the image forming apparatus.

FIG. 11(*a*) is a side view of the suction cap 92*a*, and FIG. 11(*b*) is a front view of the suction cap 92*a* when the cap is observed from the side thereof to be contacted with the nozzle surface 124.

In this example, a first holder 402 (holding plate, in this example) to restrict movement of the ink absorbent 99 in a direction perpendicular to the nozzle surface 124 (to hold the absorbent in this example), and a second holder 403 (holding plate, in this example) to restrict movement of the ink absorbent 99 in the vertical direction are provided in the suction cap 92*a*. It is preferable that the suction cap 92*a* and the first and second holders 402 and 403 are made of an elastic material such as rubbers, so that the parts can be easily prepared, and the number of parts and the number of assembling processes can be reduced.

Yet another example of setting of the ink absorbent 99 in the suction cap 92*a* will be described by reference to FIG. 12.

Figure 12:
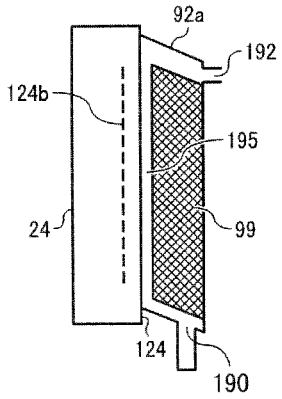
FIG. 12 illustrates yet another example of the cap to cover the recording head of the image forming apparatus.

FIG. 12 is a side view of the suction cap 92*a*. In this example, the cross section of the suction cap 92*a* has a form like parallelogram. As illustrated in FIG. 12, the suction hole 190 is located below the bottom of the surface of the suction cap 92*a* contacting the nozzle surface 124 of the recording head 24. The cross section of the ink absorbent 99 has a cross-section in a form of parallelogram similar to that of the suction cap 92*a* or a rectangular form.

When the suction cap 92*a* has such a structure as illustrated in FIG. 12, the waste ink in the cap flows toward the suction hole 190 by gravity, and therefore the waste ink can be easily removed, resulting in decrease of the amount of the waste ink in the cap.

In the above-mentioned example of the image forming apparatus, the ink is ejected horizontally toward a recording material (paper sheet 10), which is fed vertically. However, the recording method is not limited thereto. For example, the image forming apparatus can use a method in which the ink is ejected in a direction slanting relative to the vertical direction while the recording material is fed in a direction slanting relative to the horizontal direction.

In addition, although the above-mentioned example of the image forming apparatus is a serial image forming apparatus, this disclosure can also be applied to a line image forming apparatus.

Additional modifications and variations of this disclosure are possible in light of the above teachings. It is therefore to be understood that within the scope of the appended claims the invention may be practiced other than as specifically described herein.

What is claimed is:

1. An image forming apparatus comprising:

a recording head having a nozzle surface on which multiple nozzles to eject droplets are arranged in a line;

a suction device; and a cap to cover the nozzle surface of the recording head, including:

a suction hole to connect a space formed by the cap and the nozzle surface with the suction device;

an air hole to connect the space with air; and an absorbent formed inside the cap, a top surface of the absorbent being retracted from a contact portion of the cap contacting the nozzle surface of the recording head, wherein each of the suction hole and the air hole is not covered by the absorbent, and when the nozzle surface is capped with the cap, a flow passage is secured between the air hole to the suction hole and air flows through the flow passage from the air hole to the suction hole without flowing through the absorbent, wherein a longitudinal direction of the cap extends vertically, the air hole is located on an upper end of the cap and flow through the air hole is vertical, the suction hole of the cap is located on a lower end and flow through the suction hole is vertical, and the absorbent is located between the air hole and the suction hole without covering the air hole and the upper surface of the suction hole, and wherein when the nozzle surface of the recording head is capped with the cap, the absorbent is separated by a space from the nozzle surface, and both of a distance between the air hole and the nozzle surface and a distance between the suction hole and the nozzle surface are greater than a separation distance, occupied by the space, between the absorbent and the nozzle surface.

2. The image forming apparatus according to claim 1, wherein the cap further includes:

a holder to hold the absorbent to restrict movement of the absorbent, wherein the holder holds a bottom part of the absorbent to restrict movement of the absorbent in a vertical direction.

3. The image forming apparatus according to claim 1, wherein each nozzle amongst the multiple nozzles of the recording head extends horizontally, and the suction hole of the cap is located below the contact portion of the cap contacting the nozzle surface.

4. The image forming apparatus according to claim 1, wherein the recording head is arranged such that the nozzle surface extends vertically and the multiple nozzles eject droplets horizontally.

5. The image forming apparatus according to claim 1, wherein the recording head is arranged such that the nozzle surface extends vertically and the multiple nozzles eject droplets horizontally, and wherein the suction hole is located below a bottom of the contact portion of the cap contacting the nozzle surface of the recording head when the cap covers the nozzle surface.

6. The image forming apparatus according to claim 1, wherein a longitudinal direction of the absorbent inside the cap, when the nozzle surface is capped with the cap, extends vertically along the longitudinal direction of the cap, and the absorbent is disposed in a central portion of the cap to face the multiple nozzles and is not formed on the upper and lower ends of the cap on which the air hole and suction hole are respectively located, and wherein when the air hole is opened to suck the ink from the suction hole while the nozzle surface is capped with the cap, the ink passes through the flow passage by flowing from the air hole to the suction hole while passing between the absorbent and the nozzle surface without passing through an inside of the absorbent.

* * * * *